US007549733B2

(12) United States Patent
Massopust et al.

(10) Patent No.: US 7,549,733 B2
(45) Date of Patent: Jun. 23, 2009

(54) DIAPHRAGM PLATE WITH PARTIALLY-ETCHED PORT

(75) Inventors: Dan Leo Massopust, Powell Butte, OR (US); Garry Adam Jones, Sherwood, OR (US); Scott Taylor Treece, Portland, OR (US); Richard Schmachtenberg, Aloha, OR (US)

(73) Assignee: Xerox Corporation, Norwalk, CT (US)

( * ) Notice: Subject to any disclaimer, the term of this patent is extended or adjusted under 35 U.S.C. 154(b) by 477 days.

(21) Appl. No.: 11/101,763

(22) Filed: Apr. 7, 2005

(65) Prior Publication Data

US 2006/0227177 A1 Oct. 12, 2006

(51) Int. Cl.
*B41J 2/05* (2006.01)
*B41J 2/045* (2006.01)

(52) U.S. Cl. ..... 347/56; 347/70

(58) Field of Classification Search ..... 347/70–71
See application file for complete search history.

(56) References Cited

U.S. PATENT DOCUMENTS 5,551,618 A 9/1996 Shinozaki et al.
6,142,611 A 11/2000 Pan et al.
6,291,927 B1 * 9/2001 Percin et al. ..... 310/324
6,302,526 B1 * 10/2001 Lin et al. ..... 347/48
6,540,339 B2 * 4/2003 Cruz-Uribe ..... 347/70
2003/0063137 A1 4/2003 Kamei et al.

FOREIGN PATENT DOCUMENTS

EP 0564295 10/1993
EP 0903234 3/1999
EP 903234 A2 * 3/1999

OTHER PUBLICATIONS

English translation Patent Abstracts of Japan (vol. 1999, No. 2) Feb. 26, 1999.

* cited by examiner

*Primary Examiner*—Matthew Luu
*Assistant Examiner*—Lisa M Solomon
(74) *Attorney, Agent, or Firm*—Marger Johnson & McCollom, P.C.

(57) ABSTRACT

A printhead assembly that includes a partially-etched port structured to be opened by application of pressure to the port area, one or more leaflets being depressed into an internal chamber communicating with the open port.

7 Claims, 5 Drawing Sheets

FIG. 3
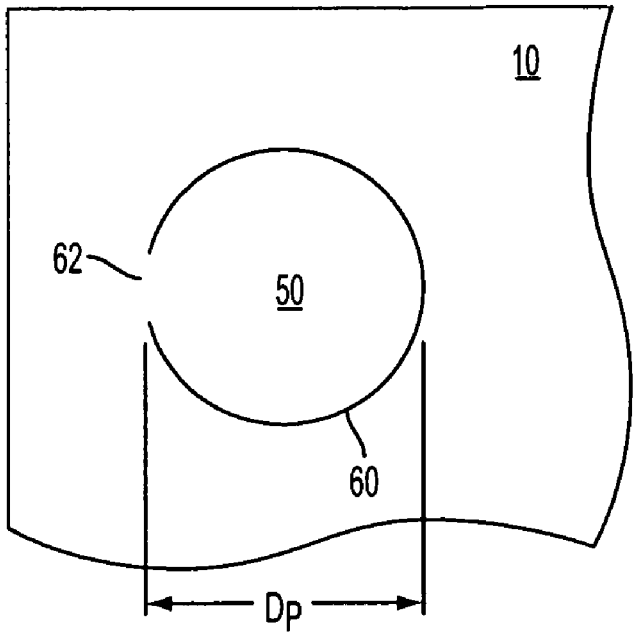
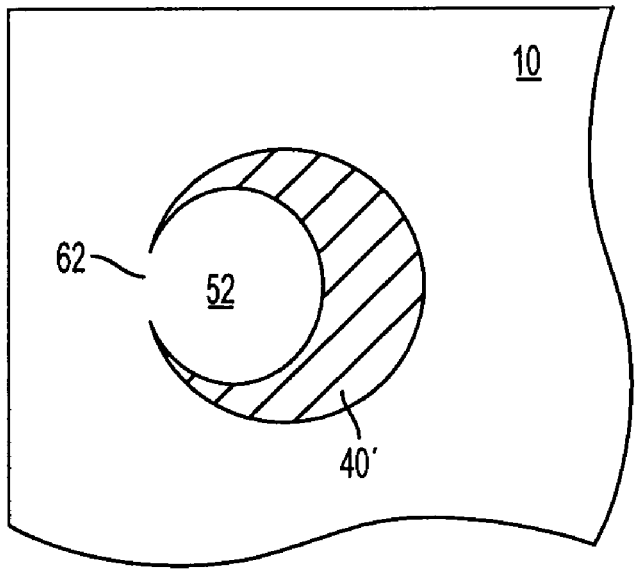
FIG. 4

DIAPHRAGM PLATE WITH PARTIALLY-ETCHED PORT

BACKGROUND

Drop on demand ink jet technology for producing printed media has been employed in commercial products such as printers, plotters, and facsimile machines. Generally, an ink jet image is formed by selective placement on a receiver surface of ink drops emitted by a plurality of drop generators implemented, for example, in a printhead comprising a stack of metal plates having fluidic chambers and channels formed therein (commonly referred to as a jet stack assembly). Ink is stored in an ink reservoir and loaded into the printhead assembly through ports in a diaphragm plate on the back side of the printhead assembly.

In printhead assembly manufacture, ports are formed in the diaphragm prior to incorporation of the diaphragm into the jet stack assembly. Ports typically are formed by etching through the diaphragm.

Some printhead assembly manufacturing methods may require that the diaphragm have no open ports during the processing of the printhead.

BRIEF DESCRIPTION OF DRAWINGS

FIG. 3 is a plan view diagram of a first embodiment of a partially-etched port.

FIG. 4 is a plan view diagram of the first embodiment partially-etched port after piercing.

DETAILED DESCRIPTION

Figure 1:
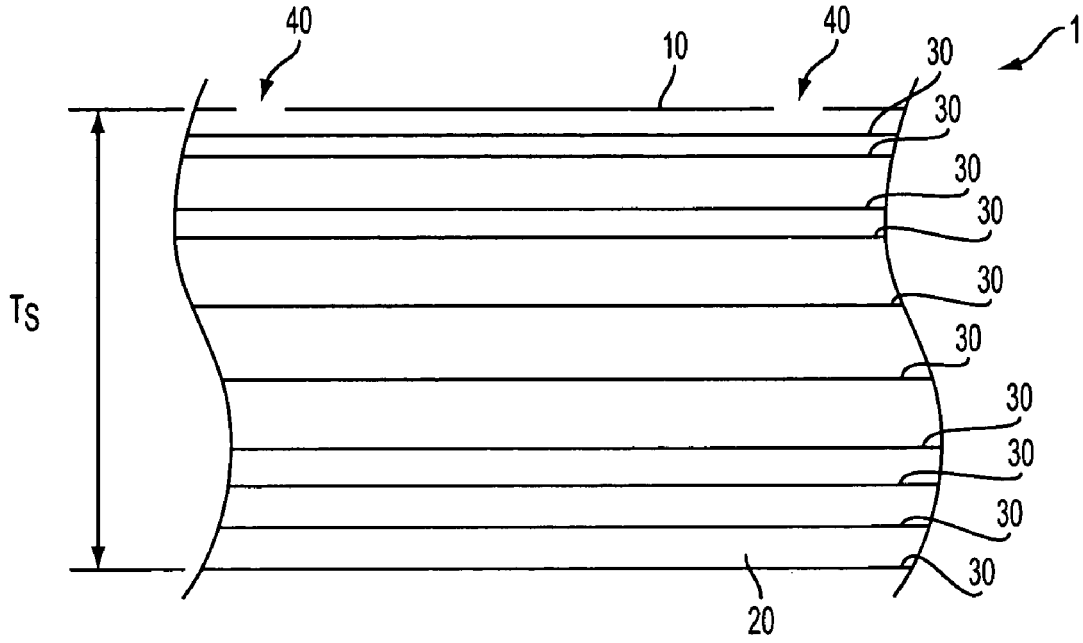
FIG. 1 PRIOR ART
FIG. 1 is a cross-sectional side view diagram of a jet stack assembly for a printhead.
Figure 2:
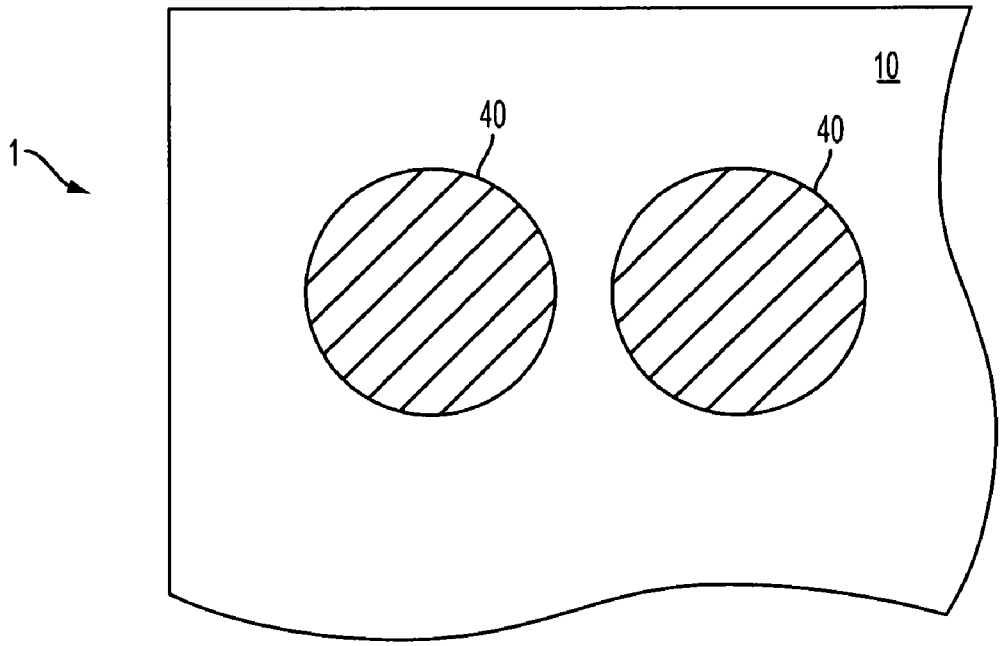
FIG. 2 PRIOR ART
FIG. 2 is a plan view diagram of the jet stack assembly of FIG. 1.

FIGS. 1 and 2 are cross-sectional side and plan view diagrams, respectively, of a printhead assembly 1 for a printhead. The printhead assembly 1 includes a diaphragm plate 10, aperture plate 20, and body 30 intermediate the aperture plate 20 and diaphragm plate 10. The printhead assembly 1 has a thickness $T_S$, which can be generally on the order of 90 mils.

By way of illustrative example, a diaphragm plate (or diaphragm) 10 of a printhead assembly 1 generally includes ports 40 permitting communication of a reservoir (not shown) and chambers 42 within the printhead assembly 1. Ports 40 can be curved in shape, with an exemplary circular port having a diameter $D_P$ of no less than 10 mils but not greater than 250 mils.

FIG. 3 is a plan view diagram of a first embodiment partially-etched port trace 50 formed on a diaphragm 10 of a printhead assembly 1. By way of illustrative example, this embodiment includes a curved port perimeter or port boundary having a partially-etched arc 60 comprising a substantial portion thereof partially-etched into the diaphragm plate 10 material. A non-etched hinge region 62 remains at the remaining portion of the curved port boundary. In this embodiment, the partially-etched arc 60 comprises about 90% of the port boundary, although a greater or lesser percentage may be efficaciously employed.

Figure 5:
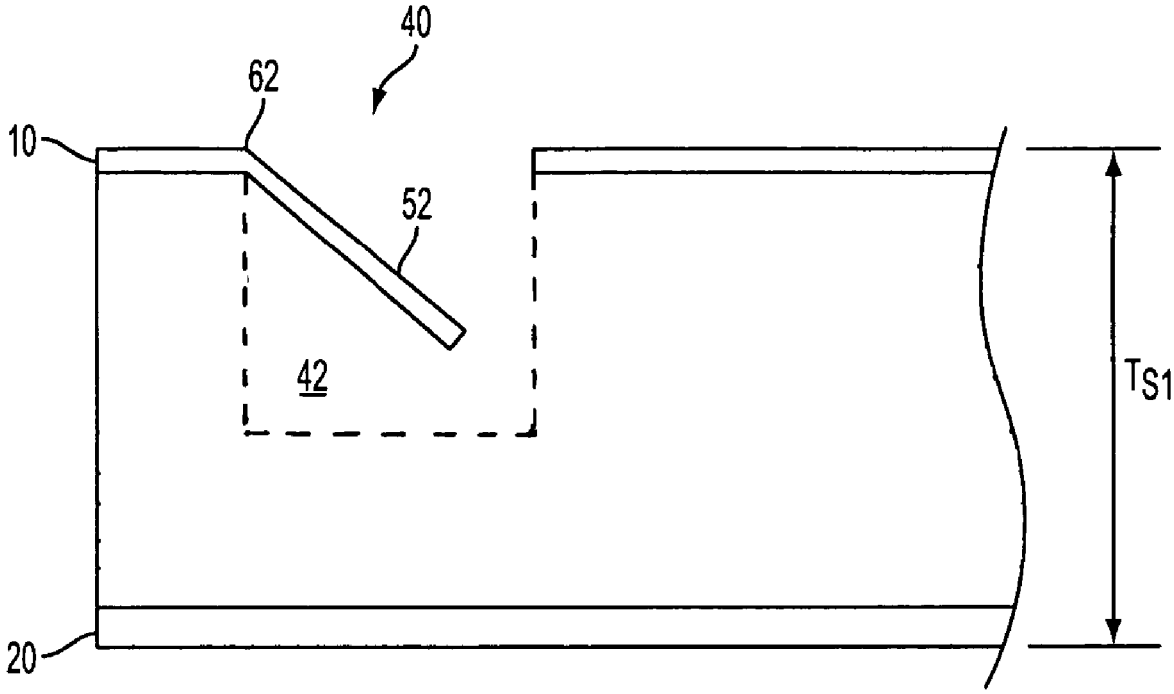
FIG. 5 is a cross-sectional side view diagram of the partially-etched port of FIG. 4 after piercing.

FIGS. 4 and 5 are plan and cross-sectional side view diagrams showing the port 40 of FIG. 3 after piercing. When pressure is applied to the port area 50, the diaphragm plate 10 fractures along the partially-etched arc 60. A port 40 is opened thereby and a leaflet 52 is formed by the depressed or pierced portion of the diaphragm plate 10.

The leaflet 52 generally is disposed at an angle to the diaphragm plate 10 after depression. It is readily appreciated that the leaflet 52 can be deflected out of the plane of the diaphragm plate 10, while the non-etched hinge region 62 retains the leaflet 52 and thereby prevents it from breaking off.

The material used to make the diaphragm plate 10 may permit the leaflet 52 to rebound slightly after depression. The hinge region 62 can be configured to provide maximum deflection of the leaflet 52 without fracture of the hinge region 62 for a given diaphragm plate 10 material.

Figure 6:
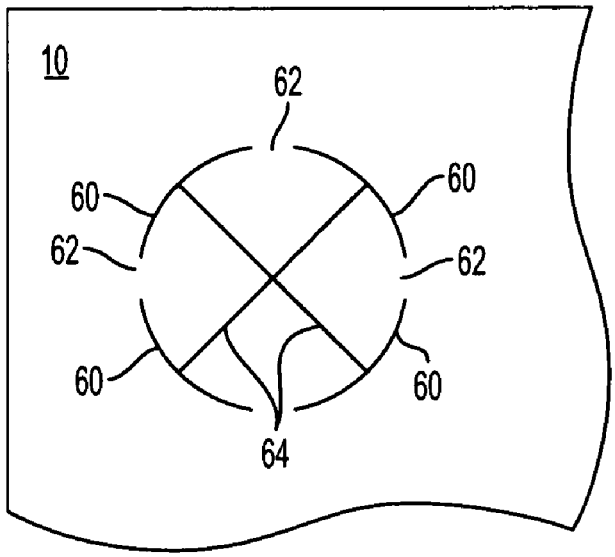
FIG. 6 is a plan view diagram of a second embodiment of a partially-etched port.

FIG. 6 is a plan view diagram of a second embodiment of a partially-etched port trace formed on a diaphragm plate 10. By way of illustrative example, the partial-etching in this embodiment includes a curved port boundary having four port boundary partial-etches 60 partially etched thereon into the diaphragm plate 10 material. Corresponding four non-etched port boundary hinges 62 remain at the curved port boundary or port perimeter. Two generally linear partial-etches 64 are further partially-etched, each generally linear partial-etch in this embodiment extending across the port boundary and connecting two port boundary partial-etches.

It should be appreciated that the above partial-etching yields a quartet of partially-etched areas 52. An individual leaflet 52 can be pie-, V- or wedge-shaped, and either of the leaflet 52 or the port trace can be considered a partially-etched predetermined portion.

Figure 7:
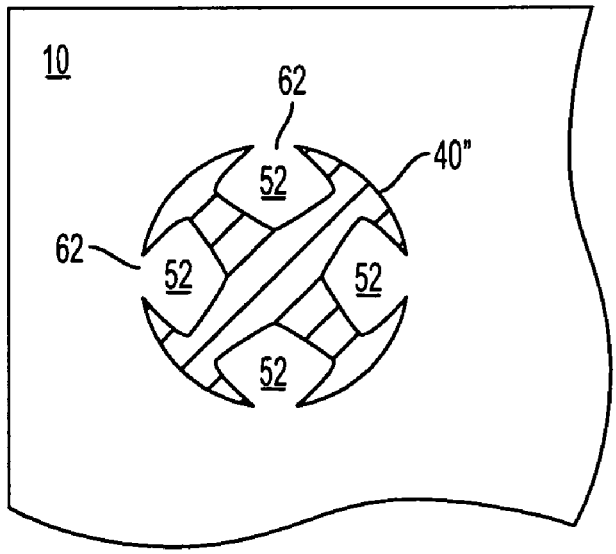
FIG. 7 is a plan view diagram of the second embodiment partially-etched port after piercing.
Figure 8:
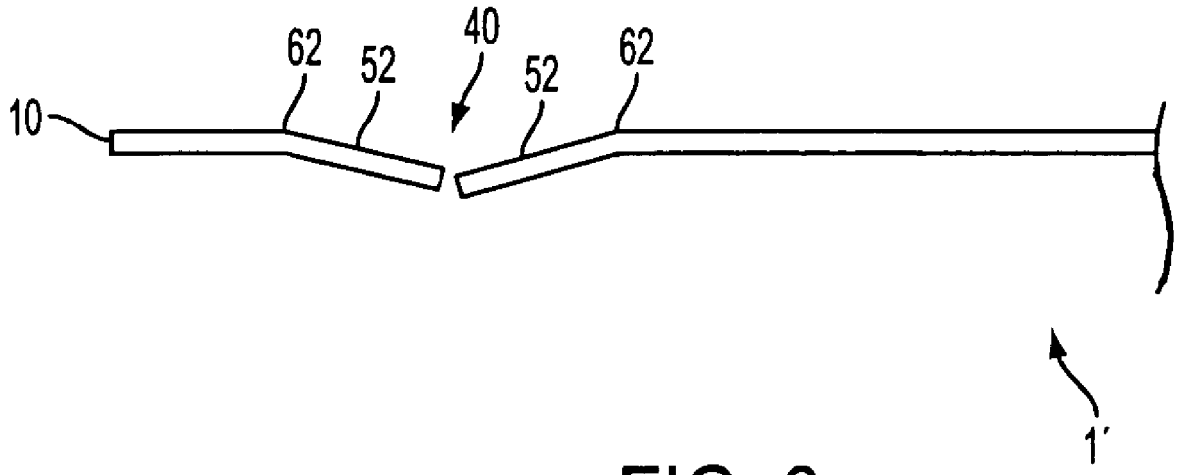
FIG. 8 is a cross-sectional side view diagram of the partially-etched port of FIG. 7 after piercing.

FIGS. 7 and 8 are plan and cross-sectional side view diagrams of the open port 40 of FIG. 6 after piercing or depression. After pressure was applied to the port area 50 from a side of the diaphragm 10, the diaphragm plate 10 material fractured along the port boundary partial-etches 60 and generally linear partial-etch 64. The port 40 was opened thereby and leaflets 52 were formed by the depressed or pierced portions of the diaphragm plate 10. The depressed leaflets 52 reside out of the plane of the diaphragm plate 10. For an embodiment wherein the diaphragm plate 10 is attached to a printhead body 30 having a fluidic chamber 42 therein, it will be appreciated that the leaflets 52 may be deflected into the body and toward the chamber 42.

The number of port boundary partial-etches 60 in the second embodiment need not be limited to four. In other embodiments, partially-etched arcs and an alternating non-etched arcs can be disposed on the diaphragm plate 10. Generally linear partial-etches 64 would be partially-etched, each generally linear partial-etch 64 disposed within the port area 50 and connecting to at least one partially-etched arc 60 on the port boundary.

By way of further illustrative example, an embodiment (not shown) similar to the embodiment of FIG. 6 may be formed having three partially-etched arcs and three radial and generally linear partial-etches, with each generally linear partial-etch extending generally from the central region of the port boundary to a partially-etched arc. It should be understood that a variety of partially-etched arc/generally linear partial-etch configurations may be employed to generate various multi-leaflet structures, and that such variations and multi-leaflet structures are within the scope of the present disclosure.

In a further embodiment, partial etching is performed on the reverse or second side of the diaphragm 10. This partial etching may but is not required to mimic the etching of the first side of the diaphragm 10. By way of example, the non-partially-etched hinge region 62 may be partially etched on a reverse side of the diaphragm 10 to facilitate hinging or to promote hinging in a specific locus or pattern.

An advantage of the present port trace 50 is that the port traces 50 are shaped in the partial-etching step and pierced to form an open port 40. The present method therefore permits utilization of elliptical, crenate or other port boundary shapes as desired.

Similarly, it is not necessary that the partially-etched arcs be of equal length; partial-etches of different lengths may be employed, resulting in non-equal leaflets. Moreover, the generally linear partial-etch of FIGS. 6-8 need not be generally linear, but may instead be partially-etched in an arcuate or curvilinear configuration. Such leaflet variations may be used to affect flow characteristics of ink through the open port and into the fluidic chamber.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A drop emitting apparatus comprising:

a body containing fluid chambers and fluid channels;

a diaphragm plate structured to be attached to the body, the diaphragm plate to provide at least one port to allow emission of fluid;

the diaphragm plate including a perimeter, the perimeter including a partially-etched predetermined portion and a non-etched perimeter portion, the perimeter to form a port, wherein the perimeter is fractured at the partially etched perimeter portion and bent at the non-etched perimeter portion, the non-etched perimeter portion structured to prevent separation of the diaphragm plate and a leaflet defined by the partial-etched portion.

2. The drop emitting apparatus of claim 1 wherein the partially-etched predetermined portion includes a partially-etched perimeter portion.

3. The drop emitting apparatus of claim 2 wherein the partially-etched perimeter portion is at least one of generally circular, generally oval-shaped, arcuate, or generally linear.

4. The drop emitting apparatus of claim 2 wherein the partially-etched predetermined portion includes a partially-etched line intersecting the partially-etched perimeter portion.

5. The drop emitting apparatus of claim 1 wherein the partially-etched predetermined portion defines a generally V-shaped segment.

6. The drop emitting apparatus of claim 1 wherein the diaphragm plate further includes a second partially-etched perimeter portion in a second region on a second side of the diaphragm plate.

7. The drop emitting apparatus of claim 1 wherein the diaphragm plate is attached to the body.

* * * * *